US010132036B2

(12) United States Patent
Collins et al.

(10) Patent No.: US 10,132,036 B2
(45) Date of Patent: Nov. 20, 2018

(54) HIGH BULK HESPERALOE TISSUE

(71) Applicant: Kimberly-Clark Worldwide, Inc., Neenah, WI (US)

(72) Inventors: Lynda Ellen Collins, Neenah, WI (US); Mark Alan Burazin, Oshkosh, WI (US); Thomas Gerard Shannon, Neenah, WI (US); Jeffrey James Timm, Menasha, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/574,312

(22) PCT Filed: May 29, 2015

(86) PCT No.: PCT/US2015/033181

§ 371 (c)(1),
(2) Date: Nov. 15, 2017

(87) PCT Pub. No.: WO2016/195629

PCT Pub. Date: Dec. 8, 2016

(65) Prior Publication Data

US 2018/0135248 A1 May 17, 2018

(51) Int. Cl.

| | |
|---|---|
| ***D21H 11/12*** | (2006.01) |
| ***D21H 11/10*** | (2006.01) |
| ***D21H 27/00*** | (2006.01) |
| ***D21H 27/38*** | (2006.01) |
| ***A47K 10/16*** | (2006.01) |
| ***D21F 11/14*** | (2006.01) |
| ***D21F 11/00*** | (2006.01) |

(52) U.S. Cl.
CPC ..... *D21H 11/12* (2013.01); *D21F 11/00* (2013.01); *D21F 11/14* (2013.01); *D21H 27/002* (2013.01)

(58) Field of Classification Search
CPC .... D21H 27/002; D21H 27/30; D21H 25/005; D21H 27/005; D21H 27/38; D21H 11/12; D21H 11/00
See application file for complete search history.

(56) References Cited

U.S. PATENT DOCUMENTS 5,320,710 A 6/1994 Reeves et al.
6,258,207 B1 * 7/2001 Pan ..... D21C 1/04 162/27
6,302,997 B1 10/2001 Hurter et al.
6,455,129 B1 9/2002 Kershaw et al.
6,511,579 B1 1/2003 Edwards et al.
7,682,488 B2 3/2010 Yeh et al.
8,049,060 B2 11/2011 Vinson et al.
8,741,104 B2 6/2014 Edwards et al.
2002/0148584 A1 * 10/2002 Edwards ..... D21F 3/0218 162/204
2003/0192662 A1 10/2003 Heath et al.
2004/0140076 A1 7/2004 Hermans et al.
2004/0168780 A1 * 9/2004 Dwiggins ..... B31F 1/07 162/125
2004/0226673 A1 * 11/2004 Edwards ..... D21F 3/0218 162/109
2005/0236122 A1 10/2005 Mullally et al.
2007/0051484 A1 3/2007 Hermans et al.
2007/0107863 A1 * 5/2007 Edwards ..... D21F 3/0218 162/111
2008/0008853 A1 1/2008 Hupp et al.
2010/0126685 A1 * 5/2010 Fike ..... B32B 27/10 162/164.7
2013/0068867 A1 3/2013 Hermans et al.
2013/0068868 A1 3/2013 Hermans et al.
2013/0071678 A1 * 3/2013 Shannon ..... B32B 5/022 428/534
2013/0199741 A1 8/2013 Stage et al.
2013/0269892 A1 10/2013 Pawar et al.
2014/0093704 A1 4/2014 Shi et al.
2014/0093705 A1 4/2014 Shi et al.
2014/0205777 A1 7/2014 Hawkins et al.
2014/0284010 A1 9/2014 Shannon
2015/0129143 A1 5/2015 Hawkins et al.
2018/0044859 A1 * 2/2018 Hermans ..... D21H 27/005
2018/0135248 A1 * 5/2018 Collins ..... D21H 27/002
2018/0135249 A1 * 5/2018 Shannon ..... A47K 7/00

(Continued)

FOREIGN PATENT DOCUMENTS

EP 2513372 B1 3/2014
GB 1374198 A 11/1974

(Continued)

OTHER PUBLICATIONS

Eugenio et al., in "Evaluation of Hesperaloe funifera pulps obtained by a low energy consumption process as a reinforcement material in recycled pulps," Forest Systems 21(3) pp. 460-467. (Year: 2012).*
Hurter, Robert W., in "Nonwood Plant Fiber Characteristics" HurterConsult pp. 1-4 (Year: 2001).*
McLaughlin, Steven in "Properties of Paper Made From Fibers of Hesperaloe Funifera (Agavaceae)," Economic Botany, 54(2) pp. 192-196. (Year: 2000).*
Co-pending U.S. Appl. No. 15/574,321, filed Nov. 15, 2017, by Shannon et al. for "SOFT Tissue Comprising Non-Wood Fibers."
Co-pending U.S. Appl. No. 15/574,331, filed Nov. 15, 2017, by Shannon et al. for "Highly Durable Towel Comprising Non-Wood Fibers."

(Continued)

*Primary Examiner* — Jose A Fortuna
(74) *Attorney, Agent, or Firm* — Kimberly-Clark Worldwide, Inc.

(57) ABSTRACT

The invention relates to tissue products comprising *hesperaloe* fibers and methods of producing the same. Preferably the *hesperaloe* fibers are high yield *hesperaloe* pulp fibers, which have demonstrated the ability to replace substantially all of the long fiber fraction of the papermaking furnish without negatively effecting important tissue product properties such as CD Stretch, CD Durability and bulk. Thus, the tissue product may comprise greater than about 90 weight percent *hesperaloe* fiber and more preferably greater than about 95 weight percent.

20 Claims, No Drawings

(56) References Cited

U.S. PATENT DOCUMENTS

| | | | | |
|---|---|---|---|---|
| 2018/0142419 | A1* | 5/2018 | Rouse | D21H 27/005 |
| 2018/0142420 | A1* | 5/2018 | Rouse | D21H 27/005 |

FOREIGN PATENT DOCUMENTS

| | | | | | |
|---|---|---|---|---|---|
| MX | 2010001159 | A | | 7/2011 | |
| WO | WO-2016195625 | A1 | * | 12/2016 | D21H 27/002 |
| WO | WO-2016195627 | A1 | * | 12/2016 | A47K 7/00 |
| WO | WO-2016195629 | A1 | * | 12/2016 | D21H 27/002 |

OTHER PUBLICATIONS

Deniz et al. in "Kraft and Modified Kraft Pulping of Bamboo (*Phyllostachys bambusoides*)," Drewno 2017, vol. 60, No. 200.

Protasio et al. in "Brazilian Lignocellulosic Wastes for Bioenergy Production: Characterization and Comparison with Fossil Fuels," BioResources 8(1), 1166-1185 (Year: 2013).

* cited by examiner

HIGH BULK HESPERALOE TISSUE

BACKGROUND OF THE DISCLOSURE

Tissue products, such as facial tissues, paper towels, bath tissues, napkins, and other similar products, are designed to include several important properties. For example, the products should have good bulk, a soft feel, and should have good strength and durability. Unfortunately, however, when steps are taken to increase one property of the product, other characteristics of the product are often adversely affected.

To achieve the optimum product properties, tissue products are typically formed, at least in part, from pulps containing wood fibers and often a blend of hardwood and softwood fibers to achieve the desired properties. Typically when attempting to optimize surface softness, as is often the case with tissue products, the papermaker will select the fiber furnish based in part on the coarseness of pulp fibers. Pulps having fibers with low coarseness are desirable because tissue paper made from fibers having a low coarseness can be made softer than similar tissue paper made from fibers having a high coarseness. To optimize surface softness even further, premium tissue products usually comprise layered structures where the low coarseness fibers are directed to the outside layer of the tissue sheet with the inner layer of the sheet comprising longer, coarser fibers.

Unfortunately, the need for softness is balanced by the need for durability. Durability in tissue products can be defined in terms of tensile strength, tensile energy absorption (TEA), burst strength and tear strength. Typically tear, burst and TEA will show a positive correlation with tensile strength while tensile strength, and thus durability, and softness are inversely related. Thus the paper maker is continuously challenged with the need to balance the need for softness with a need for durability. Unfortunately, tissue paper durability generally decreases as the fiber length is reduced. Therefore, simply reducing the pulp fiber length can result in an undesirable trade-off between product surface softness and product durability.

Besides durability long fibers also play an important role in overall tissue product softness. While surface softness in tissue products is an important attribute, a second element in the overall softness of a tissue sheet is stiffness. Stiffness can be measured from the tensile slope of stress-strain tensile curve. The lower the slope the lower the stiffness and the better overall softness the product will display. Stiffness and tensile strength are positively correlated, however at a given tensile strength shorter fibers will display a greater stiffness than long fibers. While not wishing to be bound by theory, it is believed that this behavior is due to the higher number of hydrogen bonds required to produce a product of a given tensile strength with short fibers than with long fibers. Thus, easily collapsible, low coarseness long fibers, such as those provided by northern softwood kraft (NSWK) fibers typically supply the best combination of durability and softness in tissue products when those fibers are used in combination with hardwood Kraft fibers such as Eucalyptus hardwood Kraft fibers. While Northern Softwood Kraft Fibers have a higher coarseness than Eucalyptus fibers their small cell wall thickness relative to lumen diameter combined with their long length makes them the ideal candidate for optimizing durability and softness in tissue.

Unfortunately supply of NSWK is under significant pressure both economically and environmentally. As such, prices of NSWK have escalated significantly creating a need to find alternatives to optimize softness and strength in tissue products. Alternatives, however, are limited. For example, southern softwood kraft (SSWK) may only be used in limited amounts in the manufacture of tissue products because its high coarseness results in stiffer, harsher feeling products than NSWK. Thus, there remains a need for an alternative to NSWK for the manufacture of premium tissue products, which must be both soft and strong.

SUMMARY OF THE DISCLOSURE

The present inventors have successfully used *hesperaloe* fibers to produce a tissue having satisfactory softness, strength and bulk. To produce the instant tissue products the inventors have successfully moderated the changes in strength and stiffness typically associated with substituting conventional wood papermaking fibers, such as NSWK, with *hesperaloe* fibers. Not only have the inventors succeeded in moderating changes to strength and stiffness they have done so without negatively effecting bulk. As such, the tissue products of the present invention have properties comparable to or better than those produced using conventional wood papermaking fibers, and more particularly softwood fibers, and still more particularly NSWK fibers. Accordingly, in certain preferred embodiments, the invention provides tissue products in which *hesperaloe* fibers replace at least about 95 percent of the NSWK, more preferably at least about 98 percent and still more preferably all NSWK without negatively effecting the tissue products strength, stiffness and bulk.

In still other embodiments the present invention provides a tissue product comprising at least about 90 weight percent *hesperaloe* fiber, the tissue product having a CD Stretch greater than about 15 percent and sheet bulk greater than about 15 cc/g.

In yet another embodiment the present invention provides a tissue product greater than about 90 weight percent *hesperaloe* fiber and substantially free from long average fiber length kraft fibers, such as NSWK and SSWK, the tissue product having a sheet bulk greater than about 15 cc/g, a Stiffness Index less than about 5.0 and a CD Durability greater than about 8.0.

In another embodiment the present invention provides a tissue product comprising at least one through-air dried tissue web, the web comprising at least about 90 weight percent *hesperaloe* fiber, the tissue product having a CD Stretch greater than about 14 percent, a CD Durability greater than about 8.0 and a Stiffness Index less than about 5.0.

In other embodiments the present invention provides a single-ply tissue web having a CD stretch greater than about 12 percent, such as from about 12 to about 18 percent, and a CD tensile strength from greater than about 1,000 g/3", such as from about 1,000 to about 2,500 g/3", the tissue web comprising at least about 90 weight percent high yield *hesperaloe* pulp fibers.

In still other embodiments the present invention provides a method of making a tissue web comprising the steps of: (a) forming an aqueous suspension of high yield *hesperaloe* pulp fibers (b) depositing an aqueous suspension of high yield *hesperaloe* pulp fibers onto a forming fabric traveling at a first rate of speed to form a wet web; (c) dewatering the web to a consistency of about 20 percent or greater; (d) transferring the web to a throughdrying fabric; and (e) throughdrying the web, wherein the web comprises at least about 90 weight percent high yield *hesperaloe* pulp fibers.

Definitions

As used herein, a "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm.

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "CD Durability" refers the cross-machine direction tensile energy absorption (expressed in $g \cdot cm/cm^2$) at a given cross-machine direction tensile strength (having units of grams per three inches) as defined by the equation:

$$CD\ \text{Durability} = \frac{CD\ TEA\ (\text{g}\cdot\text{cm/cm2})}{CD\ \text{Tensile}\ (\text{g/3}'')} \times 1{,}000$$

While the CD Durability may vary tissue products prepared according to the present disclosure generally have a CD Durability greater than about 8.0, more preferably greater than about 9.0 and still more preferably greater than about 10.0.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight (gsm). The resulting sheet bulk is expressed in cubic centimeters per gram (cc/g). Tissue products prepared according to the present invention generally have a sheet bulk greater than about 12 cc/g, more preferably greater than about 14 cc/g and still more preferably greater than about 16 cc/g.

As used herein, the term "fiber length" refers to the length weighted average length of fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k} (x_i \times n_i)/n$$

where k=maximum fiber length
$x_i$=fiber length
$n_i$=number of fibers having length $x_i$
n=total number of fibers measured.

As used herein, the term "*hesperaloe* fiber" refers to a fiber derived from a plant of the genus *Hesperaloe* of the family Asparagaceae including, for example, *Hesperaloe funifera*. The fibers are generally processed into a pulp for use in the manufacture of tissue products according to the present invention. Preferably the pulping process is a high yield pulping process. The high yield *hesperaloe* pulp fibers generally have a lignin content, measured as Klason lignin, from about 10 to about 15 weight percent. The terms "*hesperaloe* fiber" and "high yield *hesperaloe* pulp fiber" may be used interchangeably herein when referring to non-wood fibers incorporated into tissue products, one skilled in the art will appreciate however that when incorporating non-wood fibers into tissue products it is preferred that the fibers be processed, such as by high yield pulping.

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of kilograms per sample width, such as kg/3".

As used herein, the term "geometric mean slope" (GM Slope) generally refers to the square root of the product of machine direction slope and cross-machine direction slope. GM Slope generally is expressed in units of kg.

As used herein, the term "geometric mean stretch" (GM Stretch) generally refers to the square root of the product of machine direction slope and cross-machine direction stretch. GM Stretch generally is expressed as a percentage.

As used herein, the terms "geometric mean tensile" and "GMT" refer to the square root of the product of the machine direction tensile strength and the cross-machine direction tensile strength of the web.

As used herein, the term "Stiffness Index" refers to the quotient of the geometric mean tensile slope, defined as the square root of the product of the MD and CD slopes (having units of kg), divided by the geometric mean tensile strength (having units of grams per three inches).

$$\text{Stiffness Index} = \frac{\sqrt{MD\ \text{Tensile Slope (kg)} \times CD\ \text{Tensile Slope (kg)}}}{GMT\ (\text{g/3}'')} \times 1{,}000$$

While the Stiffness Index may vary tissue products prepared according to the present disclosure generally have a Stiffness Index less than about 5.0.

DETAILED DESCRIPTION OF THE DISCLOSURE

Generally the skilled tissue maker is concerned with balancing various tissue properties such as bulk, softness, stiffness and strength. For example, the tissue maker often desires to increase bulk without stiffening the tissue product or reducing softness, while at the same time maintaining a given tensile strength. Previous attempts to manufacture tissue using *hesperaloe* fibers have not successfully balanced these important tissue properties. For example, previous attempts have generally resulted in reduced bulk with dramatic increases in tensile and stiffness. Despite the failings of the prior art, the present inventors have now succeeded in moderating the changes in strength and stiffness without negatively effecting bulk when manufacturing a tissue product comprising *hesperaloe* fibers.

Not only were previous attempts to balance bulk, strength, stiffness and softness unsuccessful, the resulting tissue products were not suitable for use as premium bath tissue because the strengths and modulus were excessively high. For example, when compared to Northern® Bathroom Tissue the inventive code of U.S. Pat. No. 5,320,710 had 11 percent lower bulk, 23 percent greater modulus and 148 percent greater stiffness (measured as the modulus divided by the tensile strength). The present inventors have overcome these failings to provide a tissue product that is comparable or better than commercially available bath tissue products.

Without being bound by any particular theory, the high degree of strength and stiffness observed previously in tissue products may be attributed in-part to the morphology of *hesperaloe* fiber when prepared by chemical pulping, which has a relatively long fiber length, high aspect ratio and high ratio of fiber length to cell wall thickness. A comparison of fiber morphology, as reported in the literature for, *hesperaloe* kraft pulp fibers, conventional NSWK and SSWK is provided in Table 1, below.

TABLE 1

| Fiber | Fiber Length (mm) | Average Fiber Width (μm) | Cell Wall Thickness (μm) | Aspect Ratio | Fiber Length: Cell Wall Thickness |
|---|---|---|---|---|---|
| *H. Funifera* kraft pulp | 3.4 | 16.5 | 3.5 | 206 | 971 |
| NSWK | 3.5 | 36 | 6 | 97 | 583 |
| SSWK | 4.0 | 43 | 7 | 93 | 571 |

Despite the foregoing properties of *hesperaloe* kraft pulp fibers and the tendency of such pulps to produce overly strong and stiff tissue products, the present inventors have discovered that *hesperaloe* fibers processed by high yield pulping means, such as mechanical pulping, may be a suitable replacement for high fiber length wood fibers without decreasing bulk, significantly altering tensile, increasing stiffness or reducing softness. Processing of *hesperaloe* fibers by high yield pulping means generally yields a fiber having a slightly shorter fiber length and higher coarseness compared to *hesperaloe* chemical pulp fibers.

Not only have the present inventors discovered that *hesperaloe* may replace high fiber length wood fibers, such as NSWK, but also that the resulting tissue products have physical properties comparable to or better than those produced using NSWK fibers. Accordingly, in certain embodiments, *hesperaloe* fibers may replace at least about 95 percent of the NSWK in the tissue product, more preferably at least about 98 percent and still more preferably all NSWK without negatively effecting the tissue products softness and durability.

In addition to replacing substantially all of the long fiber fraction of the papermaking furnish, in certain embodiments, substantially the entire furnish may comprise *hesperaloe* fiber. Accordingly, in certain embodiments the tissue product may comprise greater than about 90 weight percent *hesperaloe* fiber and more preferably greater than about 95 weight percent. Surprisingly, forming a tissue product using a furnish consisting essentially of *hesperaloe* fiber improves the moldability of the nescient tissue web, enables the use of higher vacuum levels and improves the cross-machine direction properties, stiffness and bulk of the finished product. The improvements in these important tissue properties is illustrated in the table below, which compares a tissue product comprising a furnish of 40 weight percent *hesperaloe* and 60 weight percent EHWK and a product comprising 100 weight percent *hesperaloe* with a control comprising 40 weight percent NSWK and 60 weight percent EHWK. All of the products had a basis weight of about 38 gsm and comprised a single-ply through-air dried web manufactured using similar conditions.

TABLE 2

| *Hesperaloe* Fiber (wt %) | Delta Sheet Bulk | Delta CD Stretch | Delta Stiffness Index | Delta CD Durability |
|---|---|---|---|---|
| 40 | 5% | 22% | −15% | 20% |
| 100 | 14% | 85% | −47% | 54% |

The improved properties are further illustrated in the table below which compares the change in various tissue product properties relative to comparable tissue products comprising NSWK. All tissues shown in Table 3 are single-ply products having a basis weight of about 30 grams per square meter (gsm) and comprising either 40 weight percent NSWK and 60 weight percent EHWK or 100 weight percent *hesperaloe* fiber.

TABLE 3

| | NSWK | High Yield *Hesperaloe* Fiber | Delta (%) |
|---|---|---|---|
| Sheet Bulk (cc/g) | 24.5 | 28.06 | 14.5 |
| CD Stretch (%) | 8.31 | 15.53 | 86.9 |
| CD TEA | 2.87 | 16.84 | 487 |
| CD Durability | 6.5 | 10.0 | 53.8 |
| Stiffness Index | 6.35 | 3.32 | −47.7 |
| GM Stretch | 12 | 17.8 | 48.7 |

As illustrated in Table 3, forming a tissue product from a furnish comprising a high percentage of *hesperaloe* fiber, such as greater than about 90 weight percent, yields a product having a high degree of CD Stretch. Accordingly, in one embodiment tissue products of the present invention have a CD Stretch greater than about 12 percent, more preferably greater than about 14 percent and still more preferably greater than about 15 percent, such as from about 12 to about 18 percent. Provided these relatively high degrees of CD Stretch, the tissue products also have relatively high degrees of GM Stretch, such as greater than about 15 percent, more preferably greater than about 17 percent and still more preferably greater than about 19 percent.

In addition to having improved stretch properties, the tissue products also have improved bulk. As such, the tissue products generally have a sheet bulk greater than about 15 cc/g, more preferably greater than about 20 cc/g, still more preferably greater than about 24 cc/g and even more preferably greater than about 28 cc/g.

In other embodiments the tissue products have low stiffness, measured as Stiffness Index, and a relatively high degree of CD Durability. As such, the products are generally soft, yet extremely durable. Accordingly, the tissue products may have a CD Durability greater than about 8.0, more preferably greater than about 10.0 and still more preferably greater than about 12.0. The tissue products may also have a Stiffness Index less than about 5.0, more preferably less than about 4.5 and still more preferably less than about 4.0.

In other embodiments the present invention provides a tissue product comprising at least about 90 percent, by weight of the tissue product, high yield *hesperaloe* pulp fiber, the tissue product having a CD Stretch greater than about 12 percent, a CD Durability greater than about 8.0 and a sheet bulk greater than about 12 cc/g. In still other embodiments the present disclosure provides a tissue product having a CD Stretch greater than about 12 percent, more preferably greater than about 14 percent and still more preferably greater than about 15 percent, and a Stiffness Index less than about 5.0 and comprising from about 90 to about 100 percent, by weight of the tissue product, high yield *hesperaloe* pulp fiber.

In other embodiments the tissue products have a Stiffness Index less than about 5.0 and a CD Durability greater than about 8.0, such as from about 8.0 to about 12.0. In one particularly preferred embodiment the tissue product comprises a through-air dried web comprising at least about 95 weight percent *hesperaloe* fiber, the tissue product having a CD Durability Index greater than about 8.0 and a Stiffness Index less than about 5.0.

In still other embodiments the present invention provides tissue products having improved stretch and high sheet bulk such as a tissue product have a CD Stretch greater than 12 percent, a geometric mean stretch (GM Stretch) greater than about 15 percent and a sheet bulk greater than about 20 cc/g. The foregoing tissue products generally comprise at least about 90 weight percent *hesperaloe* fiber and in a particularly preferred embodiment are substantially free from softwood kraft fibers and particularly NSWK.

The tissue webs may be incorporated into tissue products that may be either single- or multi-ply, where one or more of the plies may be formed by a multi-layered tissue web having *hesperaloe* fibers selectively incorporated in one of its layers. In one embodiment the tissue product is constructed such that the *hesperaloe* fibers are not brought into contact with the user's skin in-use. For example, the tissue product may comprise two multi-layered through-air dried webs wherein each web comprises a first fibrous layer substantially free from *hesperaloe* fibers and a second fibrous layer comprising *hesperaloe* fibers. The webs are plied together such that the outer surface of the tissue product is formed from the first fibrous layer of each web and the second fibrous layer comprising the *hesperaloe* fibers is brought into contact with the user's skin in-use.

Generally *hesperaloe* fibers useful in the present invention are derived from non-woody plants in the genus *Hesperaloe* in the family Agavaceae. Suitable species within the genus *Hesperaloe* include, for example *H. funifera, H. nocturna, H. parviflova*, and *H. changii*, as well as combinations thereof.

In certain embodiments the *hesperaloe* fibers are processed by a high yield pulping process, such as mechanically treating the fibers. High yield pulping processes include, for example, mechanical pulp (MP), refiner mechanical pulp (RMP), pressurized refiner mechanical pulp (PRMP), thermomechanical pulp (TMP), high-temperature TMP (HT-TMP) RTS-TMP, thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW) or any modifications and combinations thereof. Processing of *hesperaloe* fibers using a high yield pulping process generally results in a pulp having a yield of at least about 85 percent, more preferably at least about 90 percent and still more preferably at least about 95 percent.

The high yield pulping process may comprise heating the *hesperaloe* fiber above ambient temperatures, such as from about to 100 to about 200° C. and more preferably from about 120 to about 190° C. while subjecting the fiber to mechanical forces. In other embodiments a caustic or oxidizing agent may be introduced to the process to facilitate fiber separation. For example, in one embodiment a 3-8 percent solution of NaOH may be added to the fiber during mechanical treatment. Although a caustic or oxidizing agent may be added during processing, it is generally preferred that the *hesperaloe* fiber is not pretreated with a chemical agent prior to processing. For example, high yield *hesperaloe* pulps are generally prepared without pretreatment of the fiber with an aqueous solution of sodium sulfite or the like, which is commonly employed in the manufacture of chemi-mechanical wood pulps.

Generally the high yield pulping process removes from about 1 to about 3 weight percent of the lignin from the *hesperaloe* fiber. As such high yield *hesperaloe* pulp useful in the present invention generally has a lignin content less than about 15 weight percent, preferably less than about 13 weight percent and still more preferably less than about 11 weight percent, such as from about 10 to about 15 weight percent.

In a particularly preferred embodiment *hesperaloe* fibers are utilized in the tissue web as a replacement for high fiber length wood fibers such as softwood fibers and more specifically NSWK or Southern softwood kraft (SSWK). In one particular embodiment the *hesperaloe* fibers are substituted for NSWK such that the total amount of NSWK, by weight of the tissue product, is less than about 10 percent and more preferably less than about 5 percent. In other embodiments it may be desirable to replace all of the NSWK with *hesperaloe* fibers such that the tissue product is substantially free from NSWK. In other embodiments *hesperaloe* fibers may be blended with SSWK fibers such that the total amount of SSWK, by weight of the tissue product, is less than about 10 percent and more preferably less than about 5 percent.

If desired, various chemical compositions may be applied to one or more layers of the multi-layered tissue web to further enhance softness and/or reduce the generation of lint or slough. For example, in some embodiments, a wet strength agent can be utilized, to further increase the strength of the tissue product. As used herein, a "wet strength agent" is any material that, when added to pulp fibers can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts, depending on the desired characteristics of the web. For instance, in some embodiments, the total amount of wet strength agents added can be between about 1 to about 60 pounds per ton (lbs/T), in some embodiments, between about 5 to about 30 lbs/T, and in some embodiments, between about 7 to about 13 lbs/T of the dry weight of fibrous material. The wet strength agents can be incorporated into any layer of the multi-layered tissue web.

A chemical debonder can also be applied to soften the web. Specifically, a chemical debonder can reduce the amount of hydrogen bonds within one or more layers of the web, which results in a softer product. Depending on the desired characteristics of the resulting tissue product, the debonder can be utilized in varying amounts. For example, in some embodiments, the debonder can be applied in an amount between about 1 to about 30 lbs/T, in some embodiments between about 3 to about 20 lbs/T, and in some embodiments, between about 6 to about 15 lbs/T of the dry weight of fibrous material. The debonder can be incorporated into any layer of the multi-layered tissue web.

Any material capable of enhancing the soft feel of a web by disrupting hydrogen bonding can generally be used as a debonder in the present invention. In particular, as stated above, it is typically desired that the debonder possess a cationic charge for forming an electrostatic bond with anionic groups present on the pulp. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty and carboxylic acid derivatives, mono and polysaccharide derivatives, polyhydroxy hydrocarbons, etc. For instance, some suitable debonders are described in U.S. Pat. Nos. 5,716,498, 5,730,839, 6,211,139, 5,543,067, and WO/0021918, all of which are incorporated herein in a manner consistent with the present disclosure.

Still other suitable debonders are disclosed in U.S. Pat. Nos. 5,529,665 and 5,558,873, both of which are incorporated herein in a manner consistent with the present disclosure. In particular, U.S. Pat. No. 5,529,665 discloses the use of various cationic silicone compositions as softening agents.

Tissue webs useful in forming tissue products of the present invention can generally be formed by any of a variety of papermaking processes known in the art. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Examples of papermaking processes and techniques useful in forming tissue webs according to the present invention include, for example, those disclosed in U.S. Pat. Nos. 5,048,589, 5,399,412, 5,129,988 and 5,494,554 all of which are incorporated herein in a manner consistent with the present disclosure. In one embodiment the tissue web is formed by through-air drying and be either creped or uncreped. When forming multi-ply tissue products, the separate plies can be made from the same process or from different processes as desired.

Test Methods

Sheet Bulk

Sheet Bulk is calculated as the quotient of the dry sheet caliper (μm) divided by the basis weight (gsm). Dry sheet caliper is the measurement of the thickness of a single tissue sheet measured in accordance with TAPPI test methods T402 and T411 om-89. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a two ply product was tested as two plies and the tensile recorded as such. Alternatively, a single ply may be tested and the result multiplied by the number of plies in the final product to get the tensile strength.

Example

Single-ply uncreped through-air dried (UCTAD) tissue webs were made generally in accordance with U.S. Pat. No. 5,607,551. The tissue webs and resulting tissue products were formed from various fiber furnishes including, Eucalyptus Hardwood Kraft (EHWK) pulp, NSWK pulp, and high yield *hesperaloe* pulp (HYH).

The EHWK furnish was prepared by dispersing about 120 pounds (oven dry basis) EHWK pulp in a pulper for 30 minutes at a consistency of about 3 percent. The fiber was then transferred to a machine chest and diluted to a consistency of 1 percent.

The NSWK furnish was prepared by dispersing about 50 pounds (oven dry basis) of NSWK pulp in a pulper for 30 minutes at a consistency of about 3 percent. The fiber was then transferred to a machine chest and diluted to a consistency of 1 percent.

The HYH was prepared by dispersing about 50 pounds (oven dry basis) HYH pulp in a pulper for 30 minutes at a consistency of about 3 percent. The fiber was then transferred to a machine chest and diluted to a consistency of 1 percent. HYH was produced by processing *H. Funifera* using a three stage non-wood pulping process commercially available from Taizen America (Macon, Ga.). The *hesperaloe* was not refined. The *hesperaloe* had an average fiber length of about 1.85 mm and a fiber coarseness of about 5.47 mg/100 m.

The stock solutions were pumped to a 3-layer headbox after dilution to 0.75 percent consistency to form a three layered tissue web. Layered tissue structures were produced as indicated in Table 4, below. The relative weight percentage of the layers was 30%/40%/30%.

TABLE 4

| Sample | Furnish Layering | Redibond 2038 A (kg/ton)/ Layer | Re-fining (min) | Vacuum (Inches Hg) |
|---|---|---|---|---|
| Control 1 | EHWK/NSWK/EHWK | 3/All | 1 | 4 |
| Control 2 | EHWK/HYH/EHWK | 0 | — | 4 |
| Inventive 1 | HYH/HYH/HYH | 0 | — | 4 |
| Inventive 2 | HYH/HYH/HYH | 0 | — | 9 |
| Inventive 3 | HYH/HYH/HYH | 0 | — | 12 |

The formed web was non-compressively dewatered and rush transferred to a transfer fabric traveling at a speed about 28 percent slower than the forming fabric. The transfer vacuum at the transfer to the TAD fabric was varied as indicated in Table 4. The web was then transferred to a T-1205-2 TAD fabric (commercially available from Voith Fabrics, Appleton, Wis. and previously disclosed in U.S. Pat. No. 8,500,955, the contents of which are incorporated herein in a manner consistent with the present disclosure). The web was then dried and wound into a parent roll. The effect of *hesperaloe* fibers on various tissue properties, including tensile, durability and softness, is summarized in the tables below.

TABLE 5

| Sample | Basis Weight (gsm) | Sheet Bulk (cc/g) | GMT (g/3") | GM Slope (kg) | CD Tensile (g/3") | CD TEA (g · cm/cm$^2$) | CD Stretch (%) |
|---|---|---|---|---|---|---|---|
| Control 1 | 29.6 | 24.5 | 576 | 3.60 | 440 | 2.87 | 8.3 |
| Control 2 | 29.1 | 25.8 | 1152 | 6.10 | 800 | 6.29 | 10.1 |
| Inventive 1 | 29.5 | 26.9 | 2306 | 9.06 | 1665 | 15.53 | 12.5 |
| Inventive 2 | 28.8 | 27.2 | 2482 | 9.05 | 1576 | 17.83 | 12.3 |
| Inventive 3 | 30.5 | 28.1 | 2583 | 8.58 | 1670 | 16.84 | 15.4 |

TABLE 6

| Sample | Stiffness Index | GM Stretch (%) | CD Durability |
|---|---|---|---|
| Control 1 | 6.26 | 12.0 | 6.5 |
| Control 2 | 5.30 | 13.9 | 7.9 |
| Inventive 1 | 3.93 | 15.8 | 9.3 |
| Inventive 2 | 3.64 | 15.8 | 11.3 |
| Inventive 2 | 3.32 | 16.4 | 10.1 |

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a tissue product comprising at least about 90 weight percent high yield *hesperaloe* pulp fibers, the tissue product having a CD Durability greater than about 8.0 and a sheet bulk greater than about 15 cc/g.

In a second embodiment the present invention provides the tissue product of the first embodiment having a CD Stretch greater than about 12 percent, more preferably greater than about 14 percent and still more preferably greater than about 15 percent.

In a third embodiment the present invention provides the tissue product of the first or the second embodiments having a CD Durability from about 8.0 to about 12.0.

In a fourth embodiment the present invention provides the tissue product of any one of the first through the third embodiments having GM Stretch greater than about 15 percent, more preferably greater than about 17 percent and still more preferably greater than about 18 percent.

In a fifth embodiment the present invention provides the tissue product of any one of the first through the fourth embodiments having a Stiffness Index less than about 5.0 and more preferably less than about 4.5 and still more preferably less than about 4.0.

In a sixth embodiment the present invention provides the tissue product of any one of the first through the fifth embodiments having a bulk greater than about 15 cc/g and more preferably greater than about 20 cc/g and still more preferably greater than about 25 cc/g.

In a seventh embodiment the present invention provides the tissue product of any one of the first through the sixth embodiments wherein the tissue product is substantially free from softwood kraft pulp fibers.

In an eighth embodiment the present invention provides the tissue product of any one of the first through the seventh embodiments comprising from about 95 to about 98 weight percent high yield *hesperaloe* pulp fibers.

In a ninth embodiment the present invention provides the tissue product of any one of the first through the eighth embodiments wherein the high yield *hesperaloe* pulp fibers have a lignin content from about 10 to about 15 weight percent.

In a tenth embodiment the present invention provides the tissue product of any one of the first through the ninth embodiments wherein the tissue product is substantially free from NSWK fibers.

In an eleventh embodiment the present invention provides the tissue product of any one of the first through the tenth embodiments wherein the tissue product comprises at least one through-air dried ply.

In a twelfth embodiment the present invention provides the tissue product of any one of the first through the eleventh embodiments wherein the tissue product comprises a single-ply uncreped through-air dried tissue web.

What is claimed is:

1. A tissue product comprising at least about 90 weight percent high yield *hesperaloe* pulp fibers, the tissue product having a CD Durability greater than about 8.0 and a sheet bulk greater than about 15 cc/g.

2. The tissue product of claim 1 having a CD Stretch greater than about 12 percent.

3. The tissue product of claim 1 having a CD Durability from about 8.0 to about 12.0.

4. The tissue product of claim 1 having a GM Stretch greater than about 15 percent.

5. The tissue product of claim 1 having a Stiffness Index less than about 5.0.

6. The tissue product of claim 1 wherein the sheet bulk is from about 20 to about 30 cc/g.

7. The tissue product of claim 1 wherein the tissue product is substantially free from softwood kraft pulp fibers.

8. The tissue product of claim 1 wherein the tissue product comprises from about 95 to about 98 weight percent high yield *hesperaloe* pulp fibers.

9. The tissue product of claim 1 wherein the high yield *hesperaloe* pulp fibers have a lignin content from about 10 to about 15 weight percent.

10. The tissue product of claim 1 wherein the tissue product comprises at least one through-air dried ply.

11. The tissue product of claim 1 wherein the tissue product comprises a single-ply uncreped through-air dried tissue web.

12. A single-ply tissue web having a percent CD stretch greater than about 12 percent and a CD tensile strength from greater than about 1,000 g/3", the tissue web comprising at least about 90 weight percent high yield *hesperaloe* pulp fibers.

13. The single-ply tissue web of claim 12 having a CD TEA greater than about 15.0 g·cm/cm2.

14. The single-ply tissue web of claim 12 having a CD Durability greater than about 8.0.

15. The single-ply tissue web of claim 12 having a basis weight from about 20 to about 60 gsm and a sheet bulk greater than about 15 cc/g.

16. The single-ply tissue web of claim 12 wherein the tissue web is a through-air dried web.

17. The single-ply tissue web of claim 12 wherein the tissue web is an uncreped through-air dried web.

18. A method of making a tissue web comprising the steps of: (a) forming an aqueous suspension of high yield *hesperaloe* pulp fibers (b) depositing an aqueous suspension of high yield *hesperaloe* pulp fibers onto a forming fabric traveling at a first rate of speed to form a wet web; (c) dewatering the web to a consistency of about 20 percent or greater; (d) transferring the web to a throughdrying fabric; and (e) throughdrying the web, wherein the web comprises at least about 90 weight percent high yield *hesperaloe* pulp fibers.

19. The method of claim 18 further comprising the step of rush transferring the dewatered web to a transfer fabric, the transfer fabric traveling at a rate of speed from about 1 to about 30 percent slower than the speed of the forming fabric.

20. The method of claim 18 wherein the throughdried web is uncreped.

* * * * *